US008578862B1

(12) United States Patent
Shirley et al.

(10) Patent No.: US 8,578,862 B1
(45) Date of Patent: Nov. 12, 2013

(54) SHOW DESK AND SHIPPING PLATFORM

(76) Inventors: Rex Shirley, San Diego, CA (US); Leslie Shirley, San Diego, CA (US); Brandon Watson, San Diego, CA (US)

( * ) Notice: Subject to any disclaimer, the term of this patent is extended or adjusted under 35 U.S.C. 154(b) by 0 days.

(21) Appl. No.: 13/528,811

(22) Filed: Jun. 20, 2012

(51) Int. Cl.
*A47B 85/00* (2006.01)

(52) U.S. Cl.
USPC ..... 108/12; 108/55.1

(58) Field of Classification Search
USPC ..... 108/147.14, 147.13, 147.12, 147.11, 108/110, 96, 53.1, 54.1, 57.1, 16, 12, 55.1, 108/55.3, 55.5
See application file for complete search history.

(56) References Cited

U.S. PATENT DOCUMENTS 622,666 A * 4/1899 Burwell ..... 108/54.1
3,147,860 A * 9/1964 Kean, Sr. et al. ..... 108/53.5
4,501,369 A * 2/1985 Fox ..... 108/147.12
4,964,350 A * 10/1990 Kolvites et al. ..... 108/110
5,797,503 A * 8/1998 Stevens et al. ..... 108/193
6,065,407 A * 5/2000 Wang ..... 108/147.13
7,428,762 B1 * 9/2008 Kalies ..... 5/627
7,540,510 B2 * 6/2009 Sparkowski ..... 108/16
7,857,329 B2 * 12/2010 Cai ..... 211/134
8,333,160 B2 * 12/2012 Lin ..... 108/147.13
2006/0130715 A1 * 6/2006 Yoo et al. ..... 108/54.1
2010/0155352 A1 * 6/2010 Hsieh ..... 211/134
2011/0303129 A1 * 12/2011 Harris ..... 108/53.1

* cited by examiner

*Primary Examiner* — Jose V Chen
(74) *Attorney, Agent, or Firm* — Buche & Associates, P.C.; John K. Buche

(57) ABSTRACT

Disclosed is a shipping platform (e.g., a cart, skid, or pallet) or a display desk, table, or shelf. In one embodiment, the apparatus may convert from a six, eight, or ten foot long shipping platform to a six, eight, or ten foot long table or shelf. The table or shelf surface may be raised or lowered and multiple apparatus can be stacked on top of each other to create larger shelves. Operably, the apparatus may be used for transportation, drayage, and storage (e.g., underneath the platform or shelf when setup as a table) of items to be displayed.

3 Claims, 7 Drawing Sheets

SHOW DESK AND SHIPPING PLATFORM

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of Invention

The present invention is in the field of shipping carts, skids or pallets which are convertible to show-tables or desks.

2. Background of the Invention

A trade fair (also known as a trade show, trade exhibition or expo) is a gathering of entities within a particular industry for showcasing and demonstrating products. Usually, products are demonstrated on tables or platforms at booths or showrooms so that drayage of the showcased or demonstrated products to said tables or platforms is often necessary. In many cases, such drayage is accomplished via the use of carts, skids, or pallets.

Although drayage via carts, skids, or pallets can result in delivery of the products to a booth or showroom, such drayage is not entirely satisfactory for all circumstances which may arise in the context of a trade show. For instance, the presence of a cart, skid, or pallet in the showroom or booth may distract trade fair attendees from the product demonstration (e.g., because of clutter or unsightliness). Furthermore, drayage can be time consuming and the drayage equipment can be expensive. Thus, a need exists for apparatus and related methods for showcasing and demonstrating products without excessive drayage costs and equipment.

Other unsatisfactory circumstances also arise in the context of trade fair product exhibitions. One such circumstance arises whenever showcased products feature varying sizes or dimensions because a different sized display table may be required for each variant of the product. For instance, carpet rolls or bundles frequently have cuts of varying lengths and diameters. Furthermore, the use of multiple tables increases equipment and transportation costs associated with attending the tradeshow. Another unsatisfactory circumstance arises in view of large product inventories at the trade show because usually only one item of product is exhibited on a display table in the show room and the remaining inventory must either be placed in a remote storage or is scattered around the show room in an unsightly manner. This circumstance usually results in either the drayage requirements of remotely stored inventory or a cluttered show room. Thus, a need further exists for product display tables and showroom storage apparatus that are capable of providing concealed storage areas and that are capable of accommodating items of varying sizes.

SUMMARY OF THE INVENTION

In view of the foregoing it is an object of this disclosure to describe an apparatus capable of being a shipping platform (e.g., cart, a skid, or a pallet) and a show table/desk of varying height, width, and/or length. It is further an object of this application to disclose methods related to said apparatus. In a preferred embodiment, the apparatus may convert from a six, eight, or ten foot long shipping cart to a six, eight, or ten foot long table or shelf. The table or shelf surface may be raised or lowered and multiple apparatus can be stacked on top of each other to create larger shelves. The height and length or width adjustment of the apparatus may suitably be accomplished via a sleeve-and-pin adjustment mechanism. Operably, the apparatus may be used in the trade show or marketing industries for transportation, drayage, and storage (e.g., underneath the platform or shelf when setup as a table) of items to be displayed.

It is yet still a further objective to meet the above identified needs in an efficient and inexpensive manner.

BRIEF DESCRIPTION OF THE FIGURES

The manner in which these objectives and other desirable characteristics can be obtained is better explained in the following description and attached figures in which.

It is to be noted, however, that the appended figures illustrate only typical embodiments of the apparatus disclosed in this application, and therefore, are not to be considered limiting of its scope, for the invention may admit to other equally effective embodiments that will be appreciated by those reasonably skilled in the relevant arts. Also, figures are not necessarily made to scale.

DETAILED DESCRIPTION OF PREFERRED EMBODIMENTS

In general the apparatus disclosed is a shipping platform (e.g., a cart, skid, or pallet) or a display desk, table, or shelf. In one embodiment, the apparatus may convert from a six, eight, or ten foot long shipping platform to a six, eight, or ten foot long table or shelf. The table or shelf surface may be raised or lowered and multiple apparatus can be stacked on top of each other to create larger shelves. Operably, the apparatus may be used for transportation, drayage, and storage (e.g., underneath the platform or shelf when setup as a table) of items to be displayed. The more specific aspects of the invention are disclosed below in connection with the appended figures.

Figure 1:
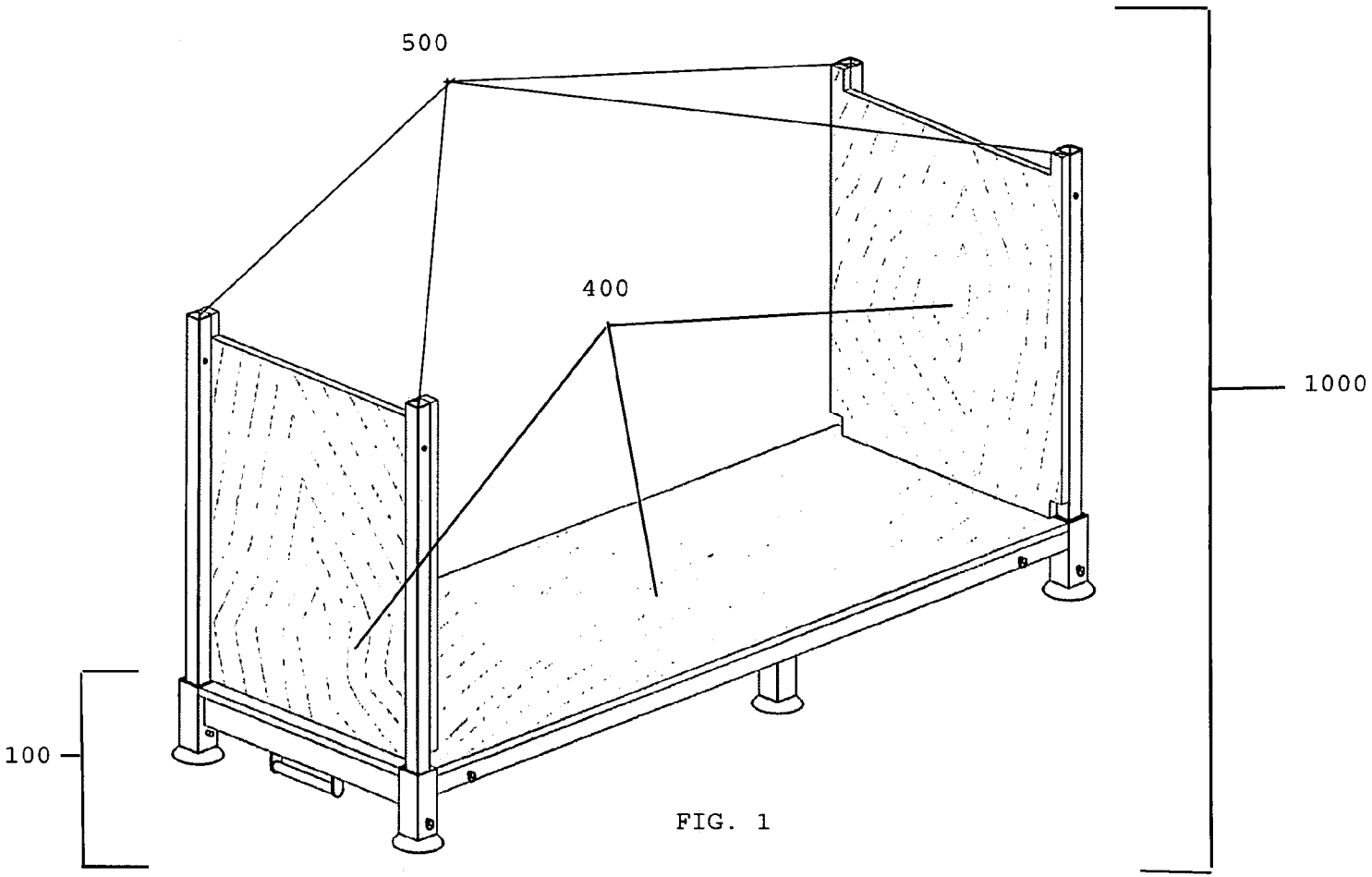
FIG. 1 is a perspective view of a show desk and shipping platform apparatus.

FIG. 1 is a perspective view of a show desk and shipping platform apparatus 1000. As shown in the figure, the apparatus 1000 is generally defined by: a first end frame 100; a second end frame 200; a center frame 300; surface panels 400; and legs 500. Still referring to FIG. 1, the first and second end frames 100, 200 are preferably assembled to opposite sides of the center frame 300 with a central surface panel 401 positioned thereover to form a rectangular support surface 450 for supporting items. The first and second end frames 100, 200 both preferably feature two corners 101, 102, 201, 202 separated by a width-member 150, 250. Suitably, the corners 101, 102, 201, 202 are defined by tubiform sleeves which feature axes that is are transverse to the support surface 450. In one embodiment, the corners 101, 102, 201, and 202 are separated by width members 150, 250 and skewered with legs 500, wherein each leg 500 is suitably (a) defined by a foot 501 and elongated midsection 502 and (b) positioned so that the leg 500 is upstanding within one of the corners 101, 102, 201, and 202. The tubiform corners 101, 102, 201, 202 and legs 500 are shown with square cross sections, but those of skill in the art will appreciate that any cooperatingly shaped cross-section will work for the leg and corner assemblies. Finally, first and second end panels 402, 403 may be provided between two legs for partially enclosing the support surface 450.

Figure 2:
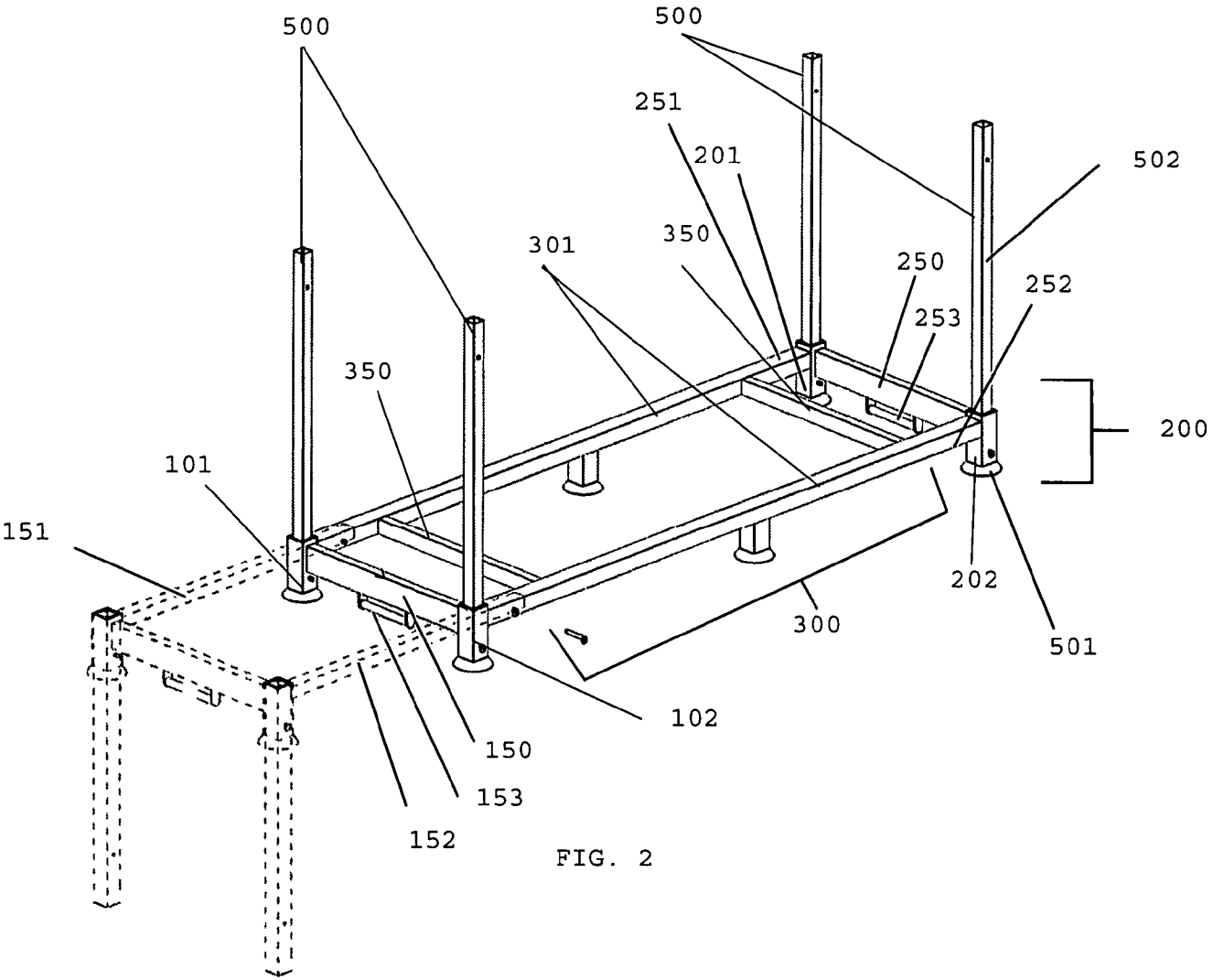
FIG. 2 is a perspective view of a frame for the apparatus of FIG. 1.

FIG. 2 is a perspective view of the apparatus of FIG. 1 with the panels 400 disassembled therefrom. Referring to FIG. 2, the first and second end frames 100, 200 may suitably comprise: the corners 101, 102, 201, 202; the width members 150, 250; and two arms 151, 152, 251, 252. Structurally, the corners 101, 102, 201, 202 may be affixed to both ends of the width members 150, 250. In one embodiment, the width members and arms define structural support beams. Preferably, one end of each arm 151, 152, 251, 252 may be provided to the corners so that each end frame 100, 200 generally defines a "U" (e.g., with the arms extending from the corners (i) in the same direction and (ii) transverse to both (a) the corners' axes and (b) the width members. The center frame 300 may be defined by parallel situated elongated sleeves 301 that are fastened together by two width members 350 that are transverse to the sleeves 301. In a preferred embodiment, the arms 151, 152, 251, 252 of the first and second end frames 100, 200 may be coaxially provided to the sleeves for assembly of the first, second, and central frames 100, 200, 300.

As alluded to above, the support surface 450 of the apparatus 1000. may be raised or lengthened. FIG. 2 illustrates the preferred mechanisms for accomplishing said raising and lowering of the surface 450. In the preferred embodiment: (1) extension of the surface 450 is accomplished via manipulation of a sleeve-and-pin mechanism (e.g., aligned apertures of a coaxial assembly that are fitted with a pin) assembled between the sleeves 301 and the arms 151, 152, 251, 252 of the first and second ends 100,200; and (2) raising of the surface 450 is accomplished via manipulation of a sleeve-and-pin mechanism assembled between the corners 101, 102, 201, 202 and the elongated midsection 501 of the legs 500.

Figure 3:
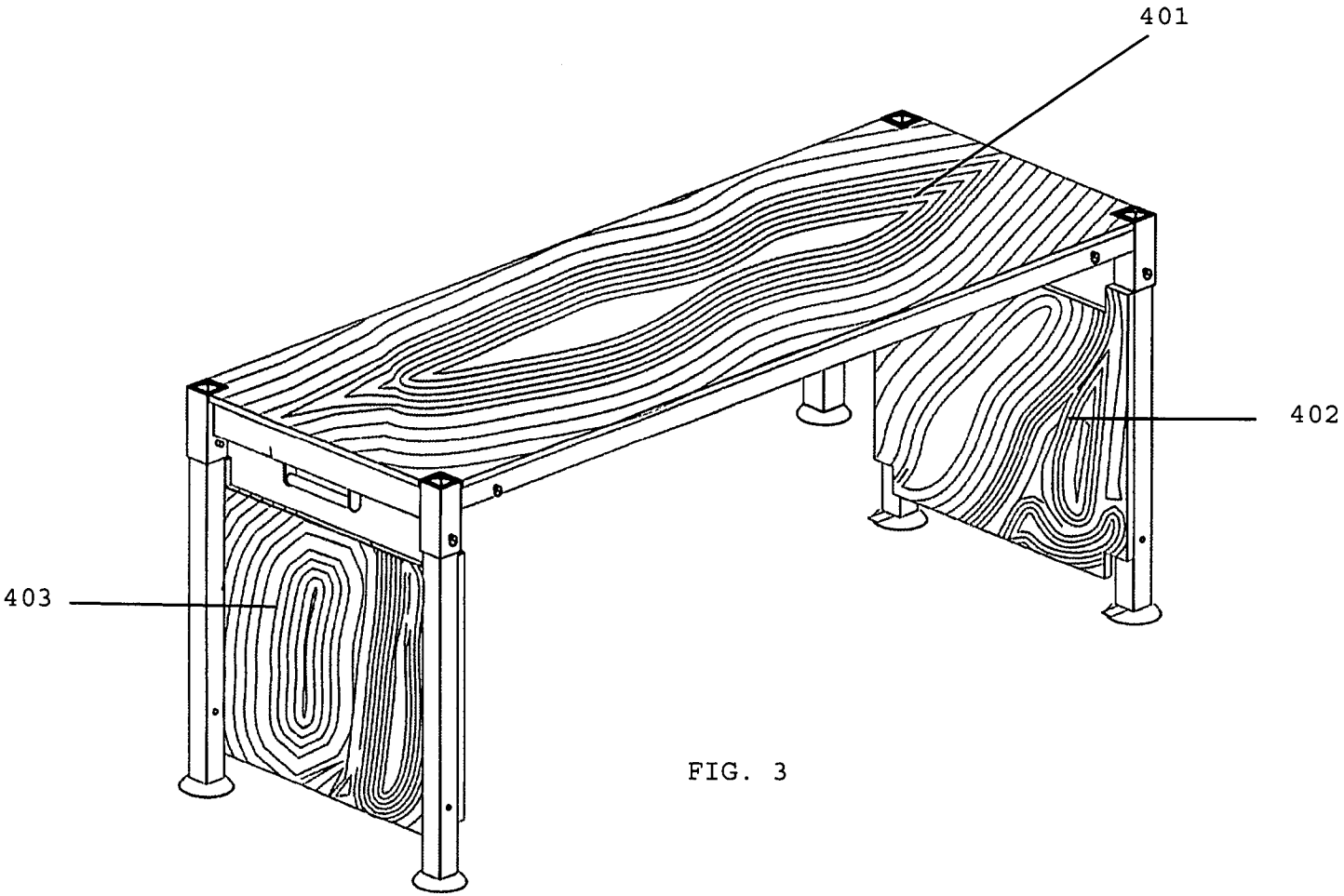
FIG. 3 is a perspective view of the apparatus of FIG. 1 in raised configuration.

FIG. 3 is a perspective view of the apparatus of FIG. 1 in a raised configuration. When taken in view of FIGS. 1 and 2, the support surface of the apparatus 1000 is positioned at the top of the legs 500 rather than at the foot 501 of the legs. In one embodiment, the surface 450 may be positioned at any point along the elongated midsection 502 of the leg 500, whereby varying heights of the table or shelf may be achieved. In one embodiment, the width members 150, 250 may be provided with handles 153, 253 for facilitating the raising and lowering of the surface 450. Once the surface is positioned at an appropriate height, the end panels 402, 403 may optionally be installed at the sides of the apparatus 1000 for partially enclosing the space underneath the support surface 450.

Figure 4:
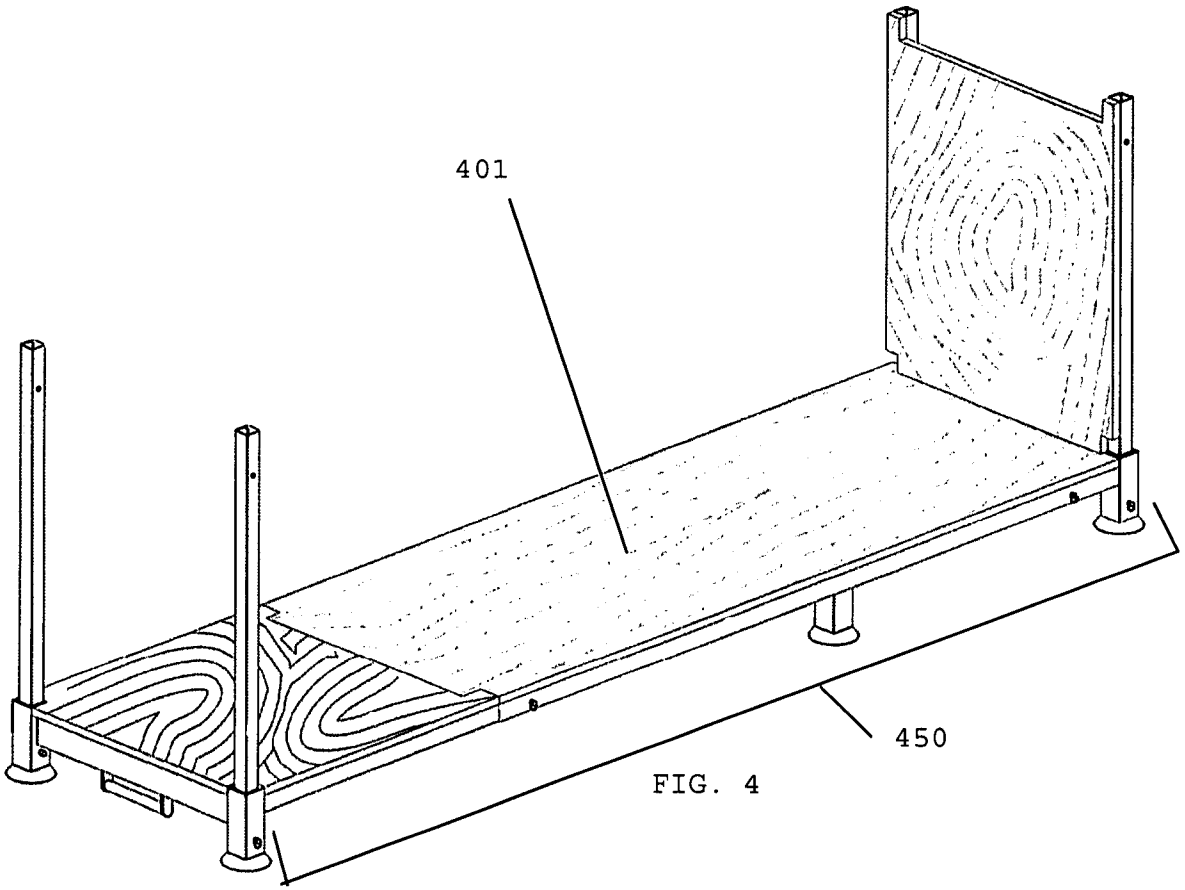
FIG. 4 is a perspective view of the apparatus of FIG. 1 in a single-extended configuration.

FIG. 4 is a perspective view of the apparatus of FIG. 1 in a single-extended configuration. When taken in view of FIGS. 1 and 2, the support surface of the apparatus is elongated toward the first end frame 100. In one embodiment, the surface 450 may be electively elongated via pulling the handle 153 so that the arms 151, 152 of the first end frame 100 withdraw from the sleeves 301. Once the first end 100 is positioned at an appropriate extension, one end panels 402 may be installed onto the extended arms 151, 152 for forming a support surface 450 with the center panel 401.

Figure 5:
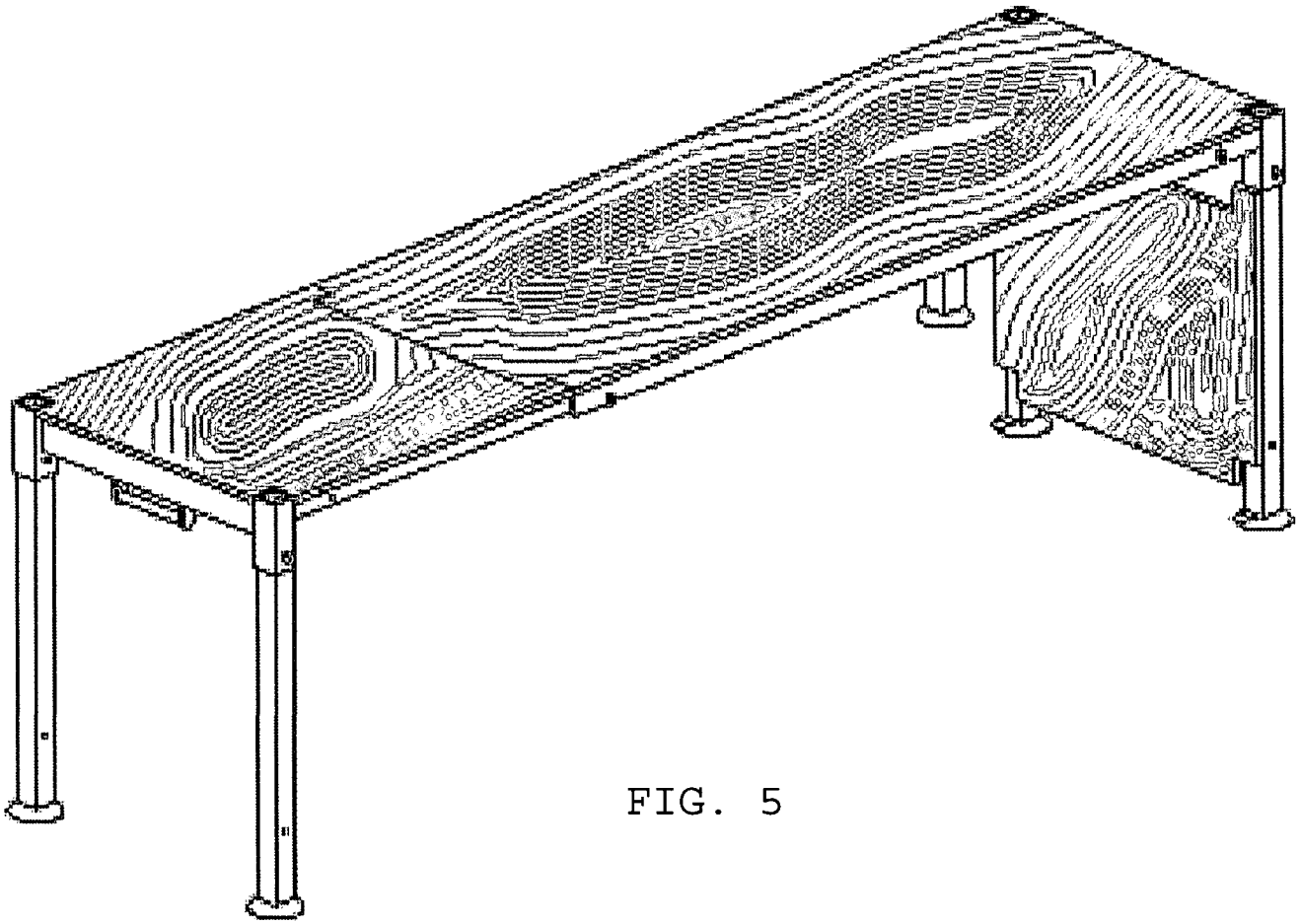
FIG. 5 is a perspective view of the apparatus of FIG. 1 in a single extended and raised configuration.
Figure 6:
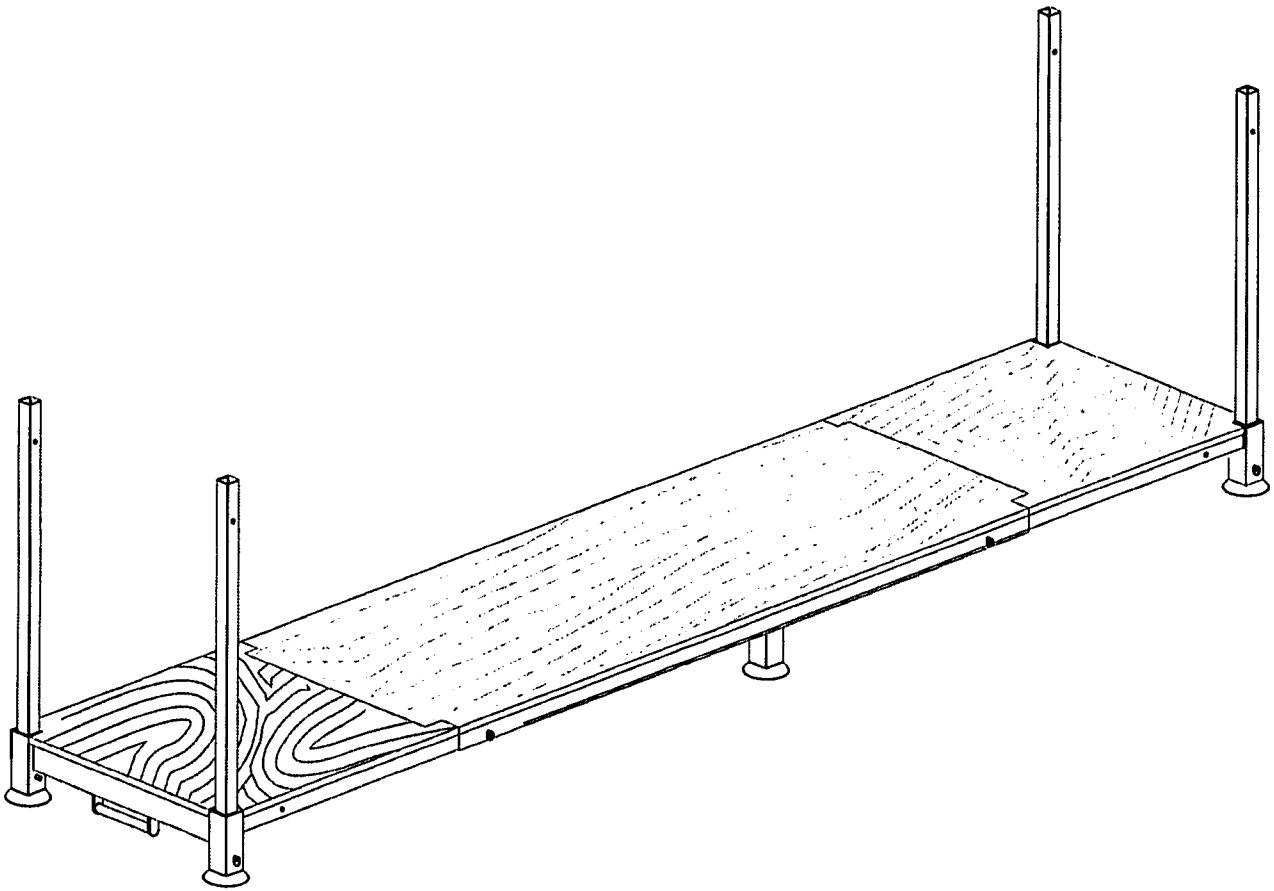
FIG. 6 is a perspective view of the apparatus of FIG. 1 in double extended configuration; and, FIG. 7 is a perspective view of the apparatus of FIG. 1 in a double extended and raised configuration.
Figure 7:
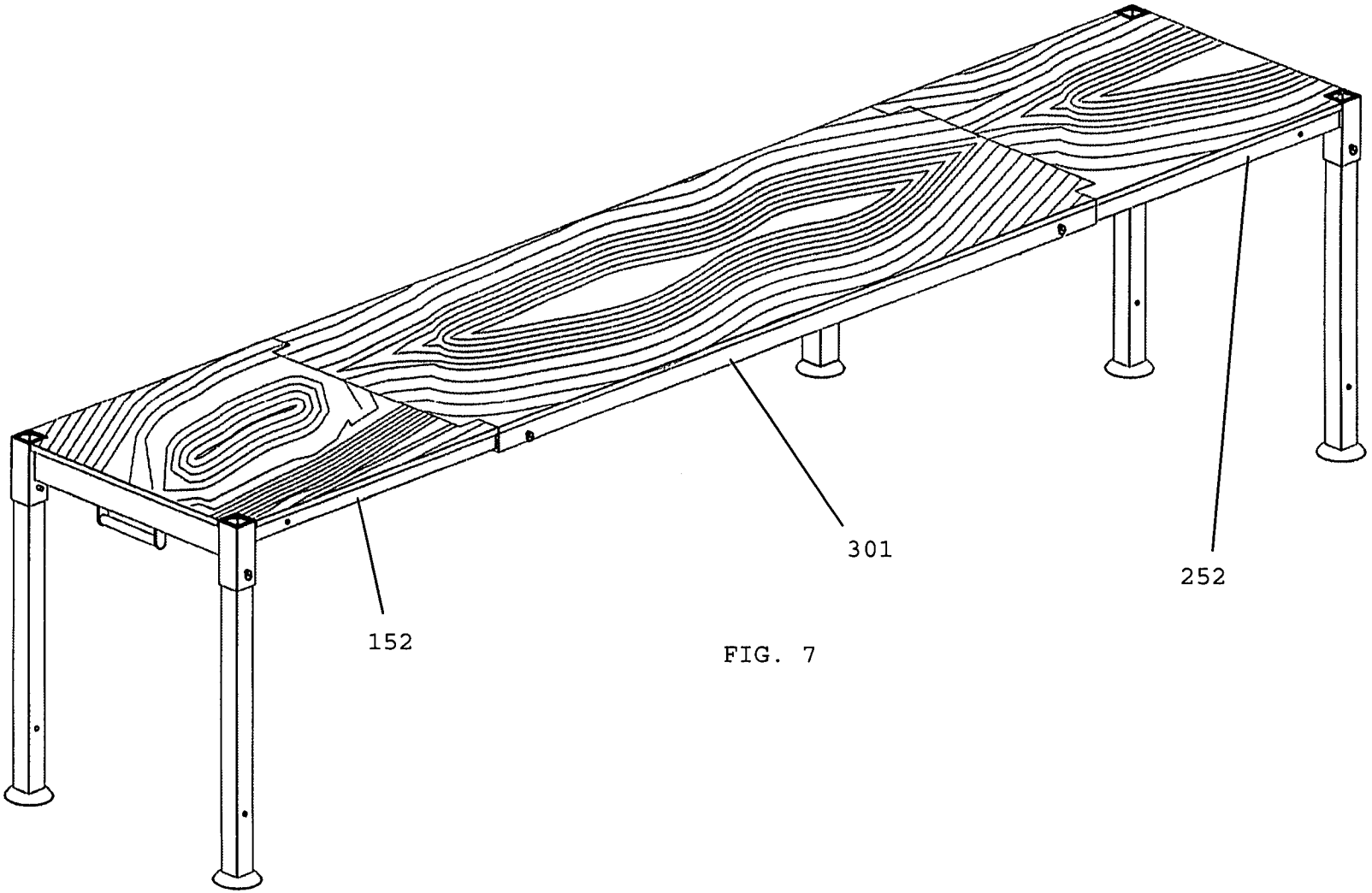

FIG. 5 is a perspective view of the apparatus of FIG. 1 in a single extended and raised configuration; FIG. 6 is a perspective view of the apparatus of FIG. 1 in double extended configuration; and, FIG. 7 is a perspective view of the apparatus of FIG. 1 in a double extended and raised configuration. It should be appreciated by those of skill in the art that the raising or lowering of the surface 450 of the apparatus 1000 may preferably be accomplished as substantially recited above. It should also be appreciated by those of skill in the art that the extension or collapse of the surface 450 of the apparatus 1000 at either end frame 100, 200 may preferably be accomplished as substantially recited above.

In one mode of operation, a plurality of apparatus 1000 may be stacked to produce shelving. In a preferred mode of operation, the feet 501 of a first apparatus 1000 may be positioned atop the legs 500 of a second apparatus 1000. When stacked, the surfaces 450 of each apparatus may be raised or lowered without obstruction. This said, It should be noted, that the surfaces of the stacked apparatus cannot be independently elongated as described above.

The apparatus may be used as a skid or display desk for carpet rolls or bundles. Preferably, for such operations, the collapsed apparatus may be six feet in length; the apparatus may be eight feet in length when extended on one side; and the apparatus may be ten feet in length when extended on both sides. In one mode of operation, a plurality of carpet rolls or bundles may be transported to a show room via the apparatus while the surface is in a down position, the rolls/bundles removed from the surface, the surface raised, one roll or bundles positioned thereon the surface for display, and the remaining rolls/bundles positioned underneath the surface for storage. In another mode of operation, a roll/bundle of six feet in length may be removed from the surface 450, the surface extended on one side, and a roll/bundle of eight feet in length may be positioned thereon the surface for display. In yet another mode of operation, a roll/bundle of six feet in length may be removed from the surface 450 of the apparatus, the surface 450 extended on two sides, and a roll/bundle of ten feet in length may be positioned thereon the surface for display In summary, disclosed are apparatus capable of being a shipping platform (e.g., cart, a skid, or a pallet) and a show table/desk of varying height, width, and/or length. In a preferred embodiment, the apparatus may convert from a six, eight, or ten foot long shipping cart to a six, eight, or ten foot long table or shelf. The table or shelf surface may be raised or lowered and multiple apparatus can be stacked on top of each other to create larger shelves. The height and length or width adjustment of the apparatus may suitably be accomplished via a sleeve-and-pin adjustment mechanism. Operably, the apparatus may be used in the trade show or marketing industries for transportation, drayage, and storage (e.g., underneath the platform or shelf when setup as a table) of items to be displayed. It should be noted that FIGS. 1 through 7 and the associated descriptions are of illustrative importance only. In other words, the depiction and descriptions of the present invention should not be construed as limiting of the subject matter in this application. Additional modifications may become apparent to one skilled in the art after reading this disclosure.

We claim:

1. A shipping platform and show desk comprising:

(A) at least four legs defined by a foot and an elongated midsection;

(B) a center frame defined by a first elongated sleeve with an open first end and an open second end, a second elongated sleeve with an open first end and an open second end and a first width member beam spanning between and fastening the first and second elongated sleeves (C) a first end frame defined by a second width member beam defined by a first tubiform corner piece at one end and a second tubiform corner piece at another end, a first arm beam extending from the first corner piece so that the first arm beam is transverse to the second width member beam, and a second arm beam extending from the second corner piece so that the second arm beam is transverse to the second width member beam wherein the second arm beam is parallel to the first arm beam;

(D) a second end frame defined by a third width member beam extending between a third tubiform corner piece and a fourth tubiform corner piece, defined by a third tubiform corner piece at one end and a fourth tubiform corner piece at another end, a third arm beam extending from the third corner piece so that the third arm beam is transverse to the third width member beam, and a fourth arm beam extending from the fourth corner piece so that the fourth arm beam is transverse to the third width member beam wherein the third arm beam is parallel to the fourth arm beam;

(E) a surface panel disposed over said elongated sleeves and first width member;

(F) wherein the first and second arm member beams are slidably and coaxially positioned inside said first open ends of the first and second elongated sleeves respectively, wherein a sleeve-and-pin length adjustment mechanism is defined by pins that are inserted into respectively aligned apertures through the first and second arm members and elongated sleeves;

(G) wherein the third and fourth arm member beams are slidably and coaxially positioned inside said second open ends of the first and second sleeve beams wherein a sleeve-and-pin length adjustment mechanism is defined by pins that are inserted into respectively aligned apertures through the third and fourth arm members and elongated sleeves; and, (H) wherein each midsection of said legs is through one of said first, second, third, or fourth tubiform corner pieces wherein a sleeve-and-pin length adjustment mechanism is defined by pins that are inserted into respectively aligned apertures through the midsections and tubiform corner pieces.

2. The transport and display apparatus of claim 1 wherein the first and second arm beams of the first end frame withdraw from the sleeves, and are lockable via manipulation of the sleeve-and-pin mechanism of the first and second arms coaxially positioned inside the central frame.

3. The transport and display apparatus of claim 2 employing at least one other support leg there that is fastened to the first elongated sleeve, wherein the leg is defined by a foot.

* * * * *